United States Patent [19]

Völlm

[11] Patent Number: 4,497,165

[45] Date of Patent: Feb. 5, 1985

[54] METHOD AND APPARATUS FOR PREPARING AND SPLICING YARN ENDS

[75] Inventor: Ernst B. Völlm, Horgen, Switzerland

[73] Assignee: Maschinenfabrik Schweiter AG, Horgen, Switzerland

[21] Appl. No.: 550,185

[22] Filed: Nov. 9, 1983

[30] Foreign Application Priority Data

Nov. 12, 1982 [CH] Switzerland ..... 6623/82

[51] Int. Cl.[3] ..... D01H 15/00

[52] U.S. Cl. ..... 57/22

[58] Field of Search ..... 57/22, 263

[56] References Cited

U.S. PATENT DOCUMENTS

| | | | |
|---|---|---|---|
| 3,339,362 | 9/1967 | Dodson | 57/22 |
| 3,487,618 | 1/1970 | Arguelles | 57/22 |
| 3,581,486 | 6/1971 | Dibble | 57/22 |
| 3,867,810 | 2/1975 | Meertens | 57/22 |
| 4,096,687 | 6/1978 | McDonald | 57/350 |
| 4,229,935 | 10/1980 | Wain | 57/22 |
| 4,342,194 | 2/1984 | Luz | 57/22 |
| 4,361,003 | 11/1982 | Bertoli | 57/22 |
| 4,393,646 | 7/1983 | Lucchetta | 57/22 |
| 4,397,137 | 8/1983 | Davies et al. | 57/22 |

FOREIGN PATENT DOCUMENTS

| | | | |
|---|---|---|---|
| 41818 | 12/1981 | European Pat. Off. . | |
| 34652 | 8/1972 | Japan | 57/22 |
| 2096660A | 10/1982 | United Kingdom . | |

*Primary Examiner*—Donald Watkins

*Attorney, Agent, or Firm*—Roylance, Abrams, Berdo & Goodman

[57] ABSTRACT

A system for preparing and splicing two yarn ends has preparation nozzles in a turbulence chamber adjacent the end faces of a casing. The preparation nozzles improve the quality of the splicing by thinning the yarn ends. Compressed air or a partial vacuum can operate the preparation nozzles. With preparation of the yarn ends in the turbulence chamber for the splicing, the expenditure for a preparation mechanism remote from the splicing casing is eliminated.

20 Claims, 5 Drawing Figures

METHOD AND APPARATUS FOR PREPARING AND SPLICING YARN ENDS

FIELD OF THE INVENTION

The present invention relates to a method and apparatus for preparing and splicing yarn ends employing one air jet to prepare the yarn ends and another air jet to splice the yarn ends, with both air jets being within the same turbulence chamber.

BACKGROUND OF THE INVENTION

When processing yarns during spooling, yarn ends often must be connected. Conventionally, the yarn ends are connected by splicing. In conventional splicing systems, the yarn ends are placed within a tubular chamber and exposed to a fluid stream or an air jet. The yarn end fibers are intimately connected forming a strong connection between the two yarns. An important aspect of the splicing operation is to provide a connection having a strength substantially equal to that of the yarn without fiber ends projecting beyond the connected parts and without the connection having a transverse cross section larger than that of the yarn being connected. A typical conventional apparatus for splicing yarns is disclosed in DE Offenlegungsschrift No. 30 49 426.

A primary requirement for obtaining a spliced joint between the yarn ends of a satisfactory quality suitable for practical operations involves reducing the cross-section of the yarn ends to be spliced. The reduction can be accomplished by brushing, untwisting or blowing the yarn ends. The cross-sectional reduction of the yarn ends facilitates the intimate intertwining of the fibers at the yarn ends. Additionally, the prepared yarn ends must not be too long. Long prepared yarn ends extend beyond the actual splicing region and wind about the yarn being connected.

The yarn ends are conventionally prepared outside of the splicing chamber, for example, in DE Offenlegungsschrift No. 29 45 504. However, preparation of the yarn ends at a location remote from the splicing operation does not permit keeping the yarn ends sufficiently short to provide a good splice joint. Although this disadvantage can be obviated by pulling the yarn ends back, the pulling operation requires a complicated yarn retracting device.

SUMMARY OF THE INVENTION

An object of the present invention is to provide a method and apparatus for preparing and splicing two yarn ends with air jets permitting the yarn end preparation and splicing to be accomplished with minimized expenditure and effort, while minimizing the length of the yarn end being prepared.

The foregoing object is obtained by a method for preparing and splicing yarn ends comprising inserting the yarn ends in a turbulence chamber, and cutting and holding the yarn ends. Subsequently, the yarn ends are prepared by first air jet produced by a pressure differential in the turbulence chamber adjacent the ends of the chamber, and are spliced by a second air jet.

The foregoing object is also obtained by an apparatus for preparing and splicing two yarn ends comprising a turbulence chamber, a splicing nozzle, and at least one preparation nozzle. The turbulence chamber extends along a longitudinal axis, and has a central area and opposite end faces. The splicing nozzle is located in the central area of the turbulence chamber and is directed perpendicularly relative to the chamber longitudinal axis. The preparation nozzle opens into the turbulence chamber and is located adjacent one of its end faces.

Other objects, advantages and salient features of the present features will become apparent from the following detailed description, which, taken in conjunction with the annexed drawings, discloses preferred embodiments of the present invention.

BRIEF DESCRIPTION OF THE DRAWINGS

Referring to the drawings which form a part of this disclosure.

DETAILED DESCRIPTION OF PREFERRED EMBODIMENTS OF THE INVENTION

Figure 1:
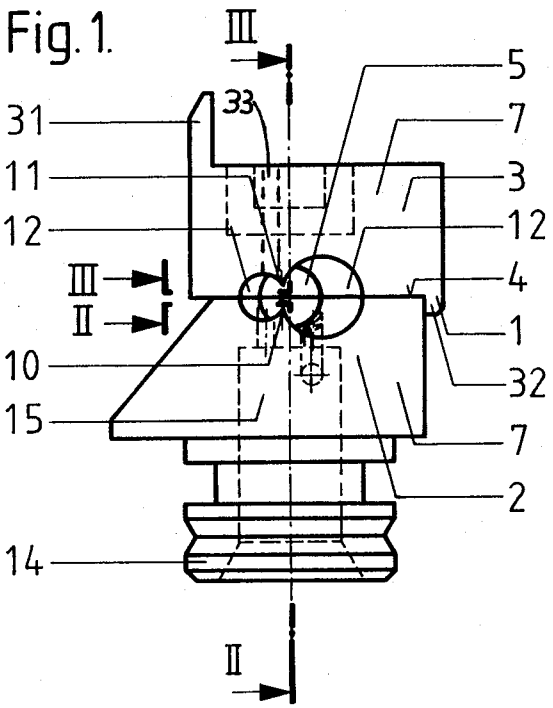
FIG. 1 is a side elevational view of an apparatus for preparing and splicing two yarn ends according to the present invention.

Referring initially to FIG. 1, the apparatus for preparing and splicing two yarn ends in accordance with the present invention comprises a casing 1 having a fixed casing part 2 and a movable casing part 3. The two casing parts 2, 3 are joined at a junction plane 4. A turbulence chamber 5 in the form of a tubular cavity extends along the entire length of the casing 1 and opens on its opposite front or end faces 6, 7. As illustrated in FIG. 1, junction plane 4 forms a plane of symmetry relative to chamber 5. Alternatively, junction plane 4 can be spaced from the plane of symmetry of chamber 5.

Figure 5:
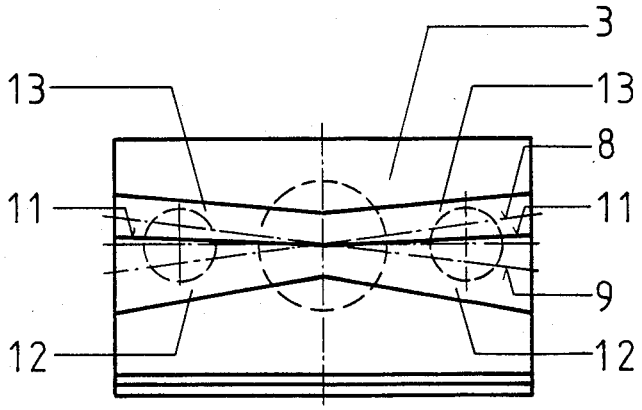
FIG. 5 is bottom plan view of the movable casing part of the apparatus of FIG. 1 viewed in the direction of arrow V in FIG. 3.
Figure 4:
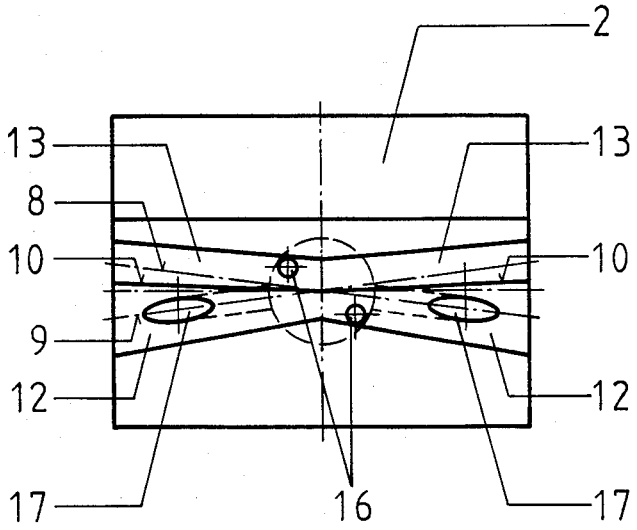
FIG. 4 is top plan view of the fixed casing part of the apparatus of FIG. 1 viewed in the direction of arrow IV in FIG. 2.

Although FIG. 1 illustrates that turbulence chamber 5 comprises two partial chambers 12, 13, the shape of those chambers is best illustrated in FIGS. 4 and 5.

Referring now to FIGS. 4 and 5, partial chambers 12 and 13 are formed by two intersecting, frustum-shaped bores extending along intersecting axes 8 and 9. These bores taper in opposite directions in both fixed casing part 2 and movable casing part 3 forming a separating web 10 in each part. Web 10 is only omitted in the crossing or intersecting area of the bore axes 8 and 9. The first partial chamber 12 comprises the parts of the two bores with the relatively larger diameter, while the second partial chamber 13 comprises the portions of the bores with the relatively smaller diameter.

Fixed casing part 2 comprises a connection piece 14 with a blind bore 15. Blind bore 15 extends to the area of turbulence chamber 5 and is used to supply compressed air to the splicing nozzles 16 (see FIG. 4) and the preparation nozzles 17 (see FIGS. 2 and 4). Connection piece 14 also mounts the fixed casing part in a suitable mounting support.

The axes of splicing nozzles 16 are oriented perpendicularly relative to junction plane 4. The axes of preparation nozzles 17 are oriented at acute angles relative to junction plane 4.

Figure 3:
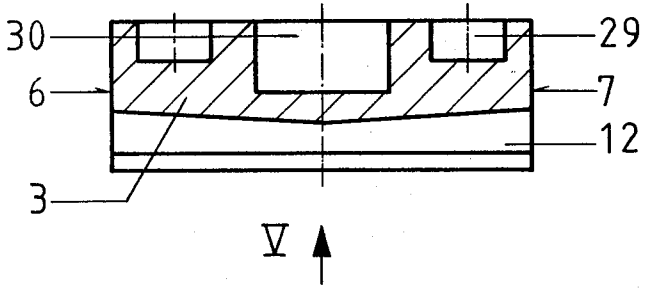
FIG. 3 is a front elevational view in section taken along lines III—III of FIG. 1 illustrating the movable casing part of the apparatus.
Figure 2:
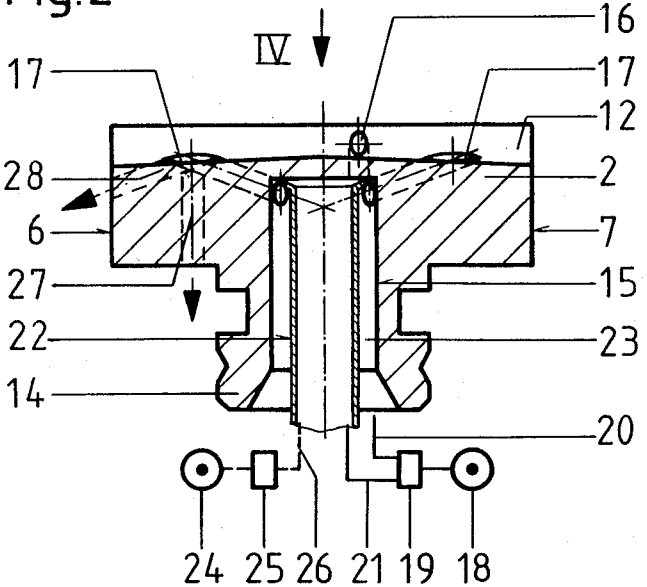
FIG. 2 is a front elevational view in section taken along lines II—II of FIG. 1 of the fixed casing part of the apparatus.

As illustrated diagrammatically in FIG. 2, a compressed air source 18 and a control system 19 are provided for supplying and controlling the flow of compressed air. Lines 20 and 21 extend from control system 19 and supply compressed air to annular space 23 formed between supply pipe 22 and blind bore 15 to be conveyed to preparation nozzles 17, and to the interior of supply pipe 22 for being conveyed to splicing nozzles 16, respectively. In order to supply nozzles 16 and 17 with different pressures, with pressures lasting for different durations, and/or in different orders, line 21 can be replaced with an independent pressure source 24 and a separate control system 25 connected to supply pipe 22 for providing compressed air in its interior through line 26. This alternative arrangement permits the yarn end preparation to be combined in a random manner with the splicing operation.

The yarns ends can be prepared using a vacuum source in lieu of a compressed air source. In using a vacuum source to create a pressure differential to generate the air jet, lines 27 and 28 (illustrated in phantom lines in FIG. 2) must be provided in lieu of the compressed air supply lines for the preparation nozzles discussed hereinabove. The arrows extending from lines 27 and 29 indicate the fluid flow in a suction or vacuum preparation operation.

Two yarn ends are joined by initially opening turbulence chamber 5 by separating movable casing part 3 from fixed casing part 4. The two yarns to be joined are then inserted such that the yarn ends are located in the area of the fluid streams to pass through preparation nozzle 17. Subsequently, movable casing part 3 is placed over fixed casing part 2 at junction plane 4 closing turbulence chamber 5. After the yarn ends are cut in the vicinity of front or end faces 6 and 7, a suitable fluid pressure medium is introduced into the apparatus in the desired order. Compressed air passing through preparation nozzles 17 cause the yarn ends to blow out, separate or brush out, while the compressed air jets from splicing nozzles 16 cause the threads of the yarns for form the desired joint. Once the joint has been formed, movable casing part 3 is again removed to permit release of the spliced yarns.

Alternative arrangements for the preparing and splicing apparatus can be employed. For example, the turbulence chamber can be formed of two, juxtaposed bores, as in Spec. No. 4,393,646, in lieu of two intersecting frustum-shaped bores. With two juxtaposed bores, at least one preparation nozzle 17 must be provided in each of the partial chambers.

Additionally, the preparation nozzles can be oriented eccentrically so that a twisting or rotating movement is supplied to the fluid stream in the longitudinal direction of the yarn ends. This twisting or rotation motion can be chosen to untwist the yarns which have been twisted by the splicing operation. The angle of preparation nozzle 17 can be chosen with a varying magnitude. Two preparation nozzles can be arranged in axial succession with the same or a different angle for a vacuum yarn end preparation system. The axes of preparation nozzles 17 can be oriented at right angles relative to junction plane 4.

The arrangement of splicing nozzle 16 can also be varied. Similar to preparation nozzle 17, splicing nozzle 16 can be arranged symmetrically relative to the medium plane of turbulence chamber 5. Alternatively, nozzle 16 can be arranged in only one partial chamber or in both partial chambers. Only one splicing nozzle can be provided.

When a separate pressure source 24 is provided for preparation nozzles 17, the yarn ends can be processed in a random manner. The random manner of operating the preparation nozzles can also be applied relative to the splicing nozzles 16.

Turbulence chamber 5 can also be oval or polygonal in cross-sectional configuration in lieu of the frustum-shaped bores. The partial chambers can also be formed without the separating web. Without the separating web, a vacuum operation for preparation nozzles 17 is preferred to avoid blowing out of the yarn ends.

Casing part 3 can be made immovable if at least one slot 33 (FIG. 1) is provided for inserting the yarn ends in turbulence chamber 5. For example, in the arrangement illustrated in FIG. 1, the slots can be arranged as intersecting slots.

Depressions 29 and a central bore 30 are formed in movable casing part 3. Depressions 29 receive springs for pressing movable casing part 3 onto junction plane 4. Central bore 30 receives a connecting part of a mechanism for moving the casing part 3. As illustrated in FIG. 1, movable casing part 3 includes a guidance rib 31 and a stop 32. The stop 32 defines the position of movable casing part 3 relative to fixed casing part 2.

While various embodiments have been chosen to illustrate the invention, it will be understood by those skilled in the art that various changes and modifications can be made therein without departing from the scope of the invention as defined in the appended claims.

What is claimed is:

1. A method for preparing and splicing two yarn ends, comprising the steps of:

inserting the yarn ends in a turbulence chamber;

cutting and holding the yarn ends;

preparing the yarn ends by opening the yarn ends with a first air jet produced by a preparation nozzle and produced by a pressure differential in the turbulence chamber adjacent an end thereof; and splicing the yarn ends with a second air jet produced by a splicing nozzle separate from said preparation nozzle.

2. A method according to claim 1 wherein the pressure differential is produced by an overpressure in the turbulence chamber.

3. A method according to claim 1 wherein the pressure differential is produced by a partial vacuum formed in the turbulence chamber.

4. A method according to claim 1 wherein the first air jet enters the turbulence chamber at an acute angle relative to the longitudinal axis of the turbulence chamber.

5. A method according to claim 4 wherein the yarn ends are prepared in separate first and second partial chambers of the turbulence chamber; and the prepared yarn ends are spliced in both of the partial chambers.

6. A method according to claim 1 wherein the yarn ends are prepared in separate first and second partial chambers of the turbulence chamber; and the prepared yarn ends are spliced in both of the partial chambers.

7. A method according to claim 1 wherein the yarn ends are prepared by the first air jet and spliced by the second air jet in a random sequence and for a random time period.

8. A method according to claim 7 wherein the yarn ends are prepared and spliced simultaneously.

9. A method according to claim 7 wherein the yarn ends are prepared and spliced sequentially.

10. A method according to claim 7 wherein the yarn ends are prepared and spliced with varying air jet pressures at different intervals.

11. A method according to claim 7 wherein the yarn ends are prepared and spliced for different time periods.

12. A method according to claim 1 wherein the first air jet is a twisting fluid stream to aid opening of the yarn end.

13. An apparatus for opening and splicing two yarn ends, comprising:

a casing with a turbulence chamber extending along a longitudinal axis and having a central area, said casing having opposite end faces;

a splicing nozzle located in said central area and directed perpendicularly relative to said longitudinal axis; and at least one preparation nozzle opening into said turbulence chamber and located adjacent one of said end faces.

14. An apparatus according to claim 13 wherein said turbulence chamber comprises first and second partial chambers separated by at least one separating web; said preparation nozzle being located in at least one of said partial chambers.

15. An apparatus according to claim 14 wherein said partial chambers extend along intersecting longitudinal axes.

16. An apparatus according to claim 14 wherein said partial chambers are juxtaposed.

17. An apparatus according to claim 13 wherein said turbulence chamber is located in a casing having a fixed part and a relatively movable part coupled at a junction plane, said junction plane intersecting said turbulence chamber.

18. An apparatus according to claim 14 wherein said turbulence chamber is located in a casing having a fixed part and a relatively movable part coupled at a junction plane, said junction plane intersecting said turbulence chamber.

19. An apparatus according to claim 13 wherein said turbulence chamber has an apex region and an insertion slot at said apex region.

20. A method according to claim 1 wherein said first air jet enters the turbulence chamber adjacent one end thereof; and said second air jet enters the turbulence chamber in a central area thereof.

* * * * *